United States Patent [19]

Takahashi et al.

[11] 4,244,491

[45] Jan. 13, 1981

[54] CONTAINER COVER MEMBER HAVING SYNTHETIC RESIN OPENABLE PORTION

[75] Inventors: Keiichi Takahashi, Ichikawa; Hiroshi Aoyama, Tokyo; Kikuya Hirakawa, Ebina; Yukio Sarusawa, Zama, all of Japan

[73] Assignee: Tokan Kogyo Co., Ltd., Tokyo, Japan

[21] Appl. No.: 969,150

[22] Filed: Dec. 13, 1978

[30] Foreign Application Priority Data

| | | | |
|---|---|---|---|
| Dec. 15, 1977 | [JP] | Japan | 52-149914 |
| Feb. 27, 1978 | [JP] | Japan | 53-20996 |
| Mar. 22, 1978 | [JP] | Japan | 53-35572[U] |
| Mar. 24, 1978 | [JP] | Japan | 53-36779[U] |
| Apr. 12, 1978 | [JP] | Japan | 53-42117 |
| Apr. 14, 1978 | [JP] | Japan | 53-43321 |

[51] Int. Cl.[3] ..... B65D 41/32

[52] U.S. Cl. ..... 220/270; 220/380; 229/43

[58] Field of Search ..... 220/307, 260, 270, 380; 229/43; 222/541

[56] References Cited

U.S. PATENT DOCUMENTS

| | | | |
|---|---|---|---|
| 3,428,212 | 2/1969 | Rohrlick | 220/307 |
| 3,952,911 | 4/1976 | Bozek et al. | 220/307 |

*Primary Examiner*—George T. Hall

*Attorney, Agent, or Firm*—Charles A. Brown

[57] ABSTRACT

A container cover member comprising a cover sheet formed of paper or thermoplastic synthetic resin having an opening of a desired size and shape in a predetermined position and over said opening a closure member having a pull tab or handle formed of thermoplastic resin which is compatible with the material of said cover sheet, said opening being easily uncovered when said pull tab is pulled up, and the process for making the cover member.

14 Claims, 18 Drawing Figures

CONTAINER COVER MEMBER HAVING SYNTHETIC RESIN OPENABLE PORTION

BACKGROUND AND FIELD OF THE INVENTION

This invention relates to a container cover member comprising a cover sheet wwhich as an opening normally closed by a closure member having a pull tab or handle and which the user can easily open by merely pulling the tab up with the fingers without separating the closure member of the cover sheet, so said cover member can be reused by replacing the closure member in the closed position.

A plurality of such cover members can be stacked as desired. A process for making the container cover member is also disclosed.

PRIOR ARTS

A variety of container covers for sealing containers which can be easily opened without the use of any separated opening or unsealing means have been proposed and developed. For example, the cover for a metal can is provided with an annular perforated or scored line to define an opening in the cover, a pull tab or handle is riveted to the cover where the opening is defined by the scored line and the container is opened by pulling the tab up thereby tearing the cover along the scored line.

The disadvantages of such prior art container cover is that it requires a relatively large number of components and accordingly, the cover requires a rather large number of production steps resulting in high production cost. Further, the cover is easily damaged in the area along the scored line, because this area is not reinforced and is weaker than the rest of the cover.

A great variety of easily openable container cover members have been employed heretofore, but all of the prior art container cover members have to be removed from the container to take the contents out of the container and frequently the covers are discarded or scattered about to thereby litter the environment. The present invention is to eliminate the disadvantages inherent in the prior art container cover members.

Any one of the prior art easily openable container cover members is produced by stamping a sheet material to provide a plurality of cover member blanks each having a desired shape and processing the blanks one by one to produce final products individually. Thus, the production of the prior art cover members are time consuming work. In addition, since the peripheral edge of the blanks must be held in a predetermined position during processing of the stamped cover member blanks, the machine processing of the blanks becomes complicated and many defective products are produced.

SUMMARY OF THE INVENTION

Therefore, one object of the present invention is to provide a container cover member which can effectively eliminate the disadvantages inherent in the prior art container cover or cover member.

Another object of the present invention is to provide a container cover member which enables the user to easily open the container with his fingers without the use of any separate opening means and which can be rapidly produced at less expense.

Another object of the present invention is to provide a container cover member which can be produced by injection-molding a closure member having a pull tab or handle integral therewith onto a cover member blank having an opening therein so that the container can be easily opened by merely pulling the pull tab up.

A further object of the present invention is to provide a container cover member which can be reused by replacing the closure member in the closed position after once opening the closure member without separating the closure member from the cover member.

A still further object of the present invention is to provide a container cover member which can be stacked without the possibility of falling.

A still further object of the present invention is to provide a process for mass producing such a container cover member at low cost.

The above and other objects and attendant advantages of the present invention will be more readily apparent to those skilled in the art from a reading of the following detailed description in conjunction with the accompanying drawings which show preferred embodiments of the invention for illustration purpose only, but not for limiting the scope of the same in any way.

PREFERRED EMBODIMENTS OF THE INVENTION

Figure 1:
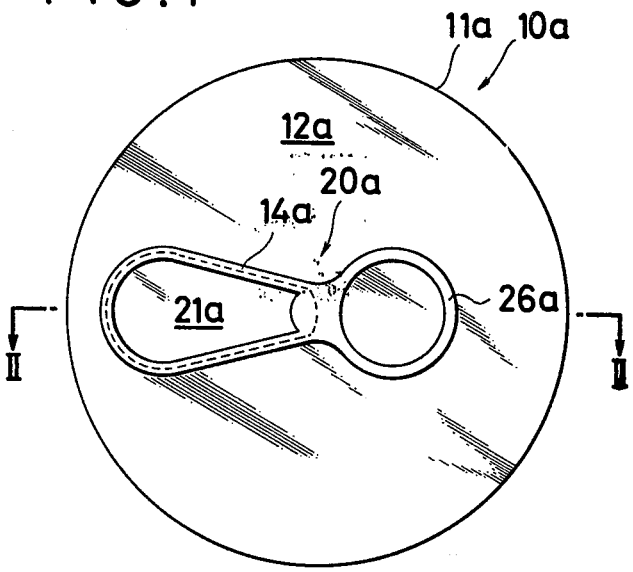
FIG. 1 is a plan view of a first embodiment of the container cover member of the present invention.
Figure 2:
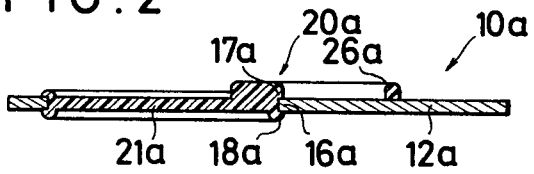
FIG. 2 is a fragmentary cross-sectional view of said cover member as shown in FIG. 1.

One embodiment of the present invention relates to a first type of container cover member which is produced by stamping a sheet material such as a paper or thermoplastic synthetic resin sheet to provide a cover member blank 11*a* having a shape corresponding to the shape of a desired or final cover member and forming an openable piece on the blank by injecting thermoplastic synthetic resin thereon. The first embodiment of the container cover member comprises the blank 11*a* which consists of a circular cover sheet 12*a* having an opening 14*a* of a suitable size formed by stamping as shown in FIG. 1. The blank 11*a* is placed into the forming mold of an injection molding machine in which an integral unsealing means 20*a* is formed on the blank 11*a* by injecting thermoplastic synthetic resin thereon to fill up the opening 14*a* as shown in FIGS. 1 and 2. The unsealing means 20*a* comprises a closure member 21*a* closing the entire opening 14*a* in the cover sheet 12*a* and having upper and lower annular engaging flanges 17*a*, 18*a* extending outwardly from the peripheral edge thereof for abutting against the upper and lower faces of the peripheral edge 16*a* of the cover sheet 12*a* which defines the opening 14*a* and an integral handle 26*a* overlying and extending outwardly of the upper engaging flange 17*a*.

Assuming that the peripheral edge 16*a* of the cover sheet 12*a* is formed of thermoplastic synthetic resin and the closure member 21*a* is formed of thermoplastic synthetic resin, when the closure member 21*a* is formed by injecting the resin so as to close or fill the opening 14*a*, the upper and lower engaging flanges of the closure member 21*a* and the peripheral edge 16*a* of the cover sheet 12*a* join together. However, when the closure member 21*a* is raised by pulling the handle 26*a* with a high force, the closure member 21*a* and cover sheet 12*a* are easily separated from each other at the interface between them or at an area of the cover sheet adjacent to the peripheral edge 16*a* thereof where the paper of the cover sheet is torn.

When the cover sheet 12*a* is formed of thermoplastic synthetic resin, even if the closure member 21*a* is formed of the same thermoplastic synthetic resin, since the closure member 21*a* is injected on the cover sheet 12*a* after the temperature of the cover sheet has lowered to normal temperature or to a value near the normal temperature, the closure member and cover sheet are joined together in the presence of a substantial difference in temperatures between them. Even in the latter case, when the closure member is pulled up or raised with a high force, the closure member is easily separated from the cover sheet. Thus, it should be noted that in all the other embodiments of the invention as well as the first embodiment described hereinabove, whether the blank 11 is formed of paper or thermoplastic synthetic resin, when the closure member 21 is formed by injecting thermoplastic synthetic resin onto the blank to connect them together, the closure member 16 can be easily separated from the cover sheet 12 at the peripheral edge 16 defining the opening 14 in the cover sheet 12.

The first embodiment of the container cover member 10*a* having the thermoplastic synthetic resin closure member 20*a* with the handle 26*a* attached thereto is applied to a container having an article or articles received therein to seal the container. When the user desires to take the article or articles out of the container, the user pulls the handle 26*a* upwardly. As the handle 26*a* is pulled upwardly, both the lower engaging flange 18*a* of the closure member 21*a* and the peripheral edge 16*a* on the cover sheet 12*a* plastically deform gradually until the lower engaging flange 18*a* of the closure member 21*a* is separated from the peripheral edge 16*a* on the cover sheet 12*a* to open the container whereby the article or articles can be taken out of the container.

Description of the corresponding components in all the other embodiments of the invention will be omitted hereinafter under the understanding that identification of the components in the first embodiment is applicable to the corresponding components in the other embodiments.

Figure 3:
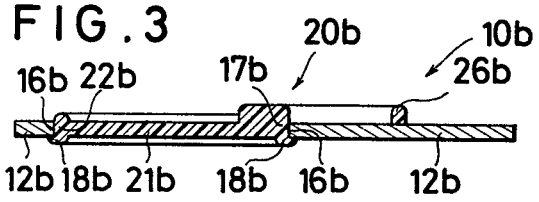
FIGS. 3 and 4 are fragmentary cross-sectional views of other embodiments of the container cover member of the present invention.

Another embodiment of the first type container cover member is shown in FIG. 3. In this embodiment, the upper and lower annular engaging flanges 17*a*, 18*a* on the closure member 21*a* abutting against the peripheral edge 16*a* of the cover sheet 12*a* as shown in the first embodiment of FIGS. 1 and 2 are eliminated and instead, a single annular engaging flange 18*b* is formed about the body of the closure member 21*b* and projecting outwardly of the closure member body for abutting against the under face of the peripheral edge 16*b* of the cover sheet 12*b*. Since the upper annular engaging flange 17*a* as provided in the first embodiment is eliminated, the appearance of the upper surface of the second embodiment container cover member is better than that of the upper surface of the first embodiment container cover member. However, since the force which holds the closure member 21*b* on the cover sheet 12 is less than the force which holds the closure member 21*a* on the cover sheet 12*a* in the first embodiment, it is advisable to apply any suitable adhesive to the edge 22*b* of the closure member 21*b* facing the peripheral edge 16*b* of the cover sheet 12*b* and to the upper face of the flange 18*b* on the closure member 21*b* prior to the injection molding of the closure member to thereby improve the adhesion between the cover sheet and closure member. Also in the second embodiment, when the handle 26*b* is pulled up or raised, the flange 18*b* plastically deforms to thereby make it easy to open the container.

Figure 4:
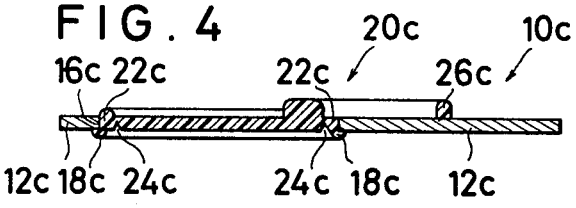

The third embodiment of the first type cover member of the invention is shown in FIG. 4 and in this embodiment, an annular groove 24*c* is cut extending from the underside of the flange 18*c* to a position short of the upper surface of the closure member body in a position adjacent to the periphery of the closure member 21*c* of the unsealing means 20*c* to reduce the thickness at the particular area of the closure member so that when the handle 26*c* is pulled up, the closure member 21*c* breaks easily at the groove 24*c* and separates from the cover sheet 12*c* leaving the portion 22*c* of the closure member 21*c* including the flange 18*c* positioned outwardly of the groove 24*c* whereby the container can be easily opened.

Figure 5:
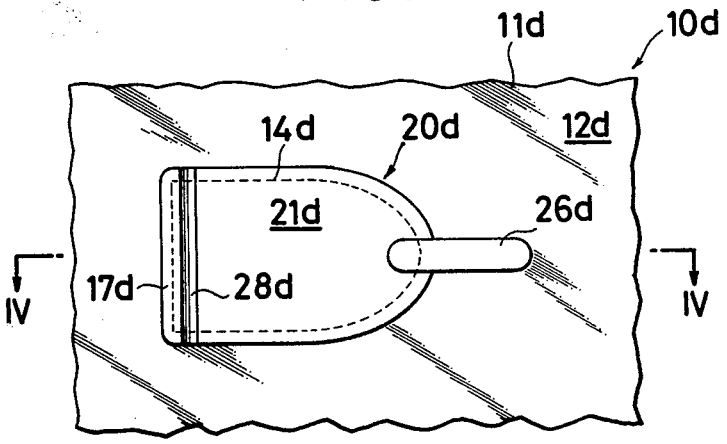
FIG. 5 is a fragmentary plan view of another embodiment of the container cover member which has a hinge means of the present invention.
Figure 6:
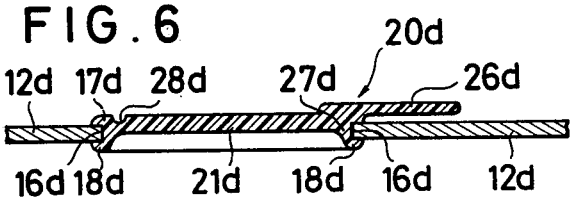
FIG. 6 is a cross-sectional view of the embodiment as shown in FIG. 5.

The fourth embodiment of the container cover member of the present invention or a hinged cover member 10*d* which is of the second type is shown in FIGS. 5 and 6. As shown in these Figures, the integral opening means 20*d* is formed by injection-molding thermoplastic synthetic resin onto the cover sheet 12*d* having an opening 14*d* of a desired size formed therein. The opening means 20*d* comprises the closure member 21*d* having upper and lower annular engaging flanges 17*d*, 18*d* abutting against the upper and lower faces of the peripheral edge 16*d* of the cover sheet 12*d*, the integral handle 26*d* in a position in the periphery of the body of the closure member and a grooved or hinge portion 28*d* provided in the upper surface of the body of the closure member 21*d* to reduce the thickness or strength of the closure member. When it is desired to improve the adhesion between the main body 12*d* and closure member 21*d*, prior to the injection molding forming of the opening means 20*d*, a suitable adhesive is applied to the face of the peripheral edge 16*d* on the cover sheet 12*d* and to the upper (or lower) face of the lower annular flange 18*d*. With the above-mentioned construction and arrangement of the components of the cover member 10*d*, when the handle 26*d* is raised or pulled up, the under engaging flange 18*d* and peripheral edge 16*d* plastically deform at the base 27*d* of the handle 26*d* to open the container and as the handle 26*d* is further pulled up, the closure member 21*d* pivots about the groove or hinge portion 28*d* to perfectly uncover the opening 14*d* in the cover sheet 12*d*.

Figure 7A:
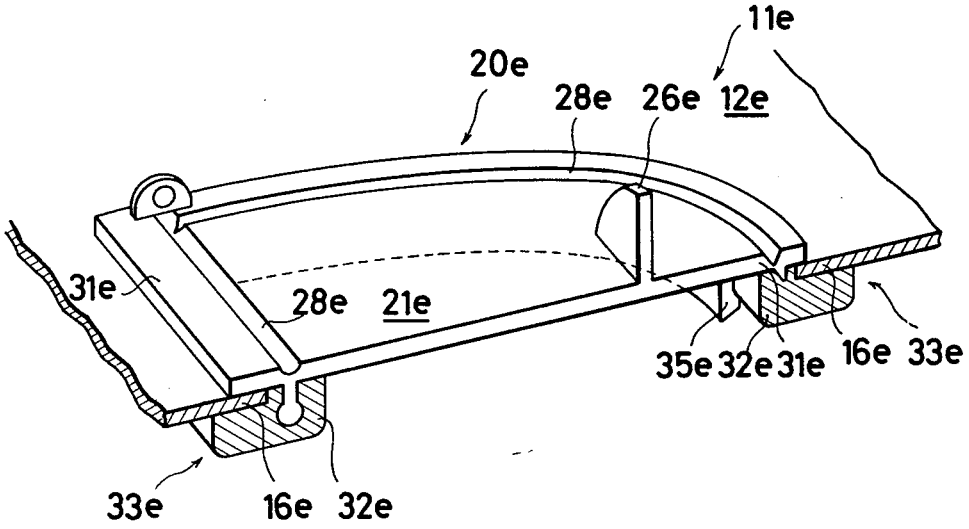
FIG. 7A is a fragmentary perspective view in section of another embodiment of the container cover member of the present invention, and FIG. 7B showing the same in the opened position.
Figure 7B:
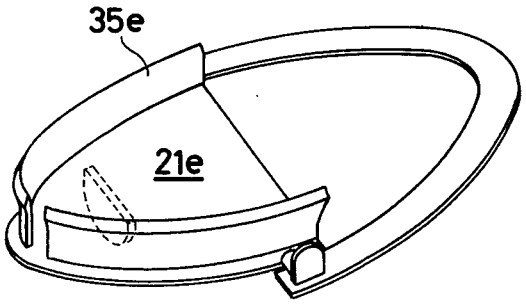

The fifth embodiment of the cover member 10*e* of the present invention which comes under the second type is shown in FIGS. 7A, 7B. In this embodiment, an annular backing member 33*e* is firmly adhered to the underside of the thermoplastic synthetic resin closure member 21*e* by injection molding on the cover sheet 12*e* having the opening 14*e* of a suitable size therein defined by the peripheral edge 16*e*. The backing member has an annular projection 32*e* protruding upwardly at the inner peripheral edge thereof to abut against the under fact of the peripheral edge 16*e* of the cover sheet 12*e* and extending into the opening 14*e*. The handle 26*e* is formed in position in the periphery of the closure member 21*e* and the notch or hinge portion 28*e* is also formed in the periphery of the closure member in a position diametrically opposite to the handle 26*e* to provide a peripheral extension 31*e* to thereby complete the unsealing means 20*e*. The closure member 21*e* is further formed with an engaging leg 35*e* on the underside thereof adjacent the periphery to engage the backing member 33*c*.

The area of the underside of the closure member 21*e* just below the notch or hinge portion 28*e* is firmly secured to the annular projection 32*e* by any suitable means.

In the embodiment of FIG. 7A, 7B, when the handle 26*e* is pulled up, the engaging leg 35*e* of the plastic backing member 33*e* plastically deforms to separate from the projection 32*e* of the backing member 33*e* and the closure member 21*e* is pivoted about the hinge portion 28*e* to uncover the opening 14*e* to thereby open the container. When the container is desired to be closed again, the plastic engaging leg 35*e* is caused to plastically deform by pushing the closure member 21*e* into the opening 14*e* until the lower end of the leg 35*e* engages the projection 32*e* whereupon the container is sealed.

Figure 8:
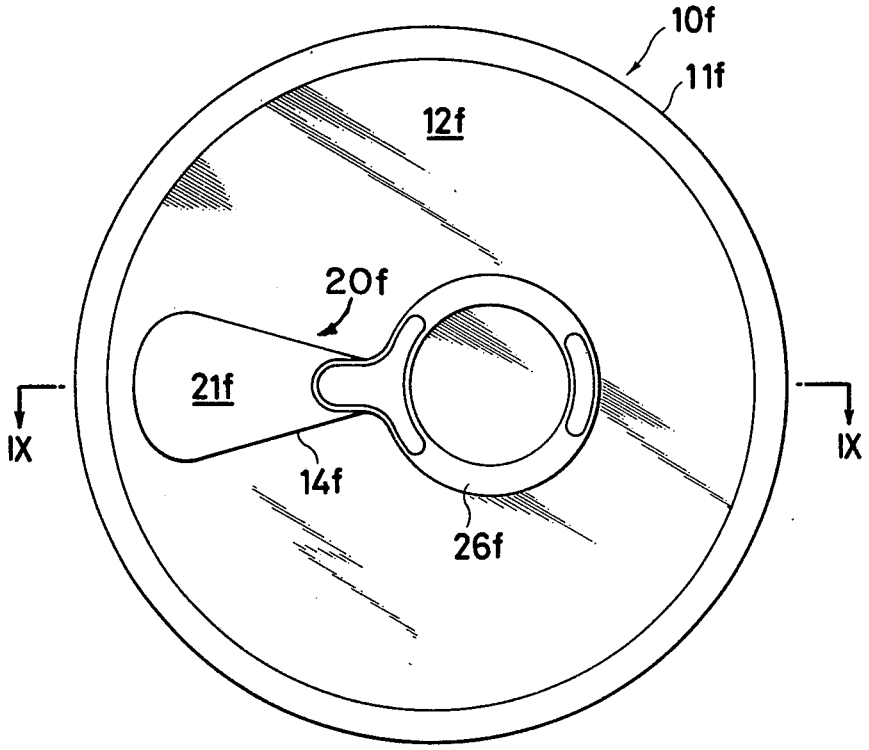
FIGS. 8 and 9 are plan and cross-sectional views, respectively, of another embodiment of the container cover member of the present invention capable of being stacked.
Figure 9:
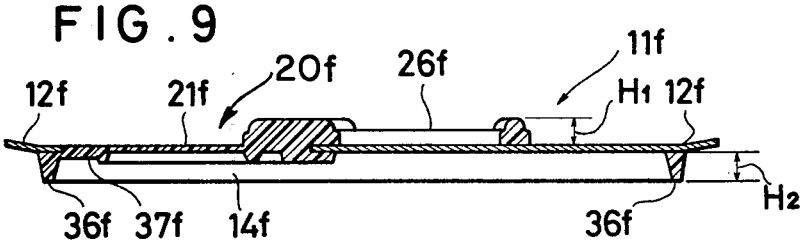

The sixth embodiment of the container cover member 10*f* of the present invention which comes under a third type is shown in FIGS. 8 and 9 and the container cover member comprises the cover sheet 12*f* having the opening 14*f* therein and the unsealing means 20*f* with the handle 26*f* formed by injection-molding thermoplastic synthetic resin onto the blank. In this embodiment, the opening means 20*f* has an annular rib 36*f* projecting downwardly from the underside of the closure member 21*f* by a height $H_2$ greater than the height $H_1$ of the handle 26*f* above the closure member 12*f* and the handle 26*f* and rib 36*f* are connected together by means of a resin connector 37*f*.

With the above mentioned construction and arrangement of the components of the container cover member 10*f*, when the handle 26*f* is pulled up, the closure member 21*f* is pivoted upwardly about the hinge portion or resin connector 37*f* to open the container in the manner as mentioned in connection with the foregoing embodiments. Since the closure member 21*f* is provided on the underside thereof with the annular rib 36*f* having the height $H_2$ greater than the height $H_1$ of the handle 26*f* projecting above the upper surface of the closure member 21*f*, when a plurality of the cover members 10*f* are placed one upon another, the closure member 21*f* and handle 26*f* are received in the recess defined by the annular rib 36*f* on the adjacent upper cover member 10*f* whereby the handle 26*f* is protected against possible damage and a stack of the cover members can be prevented from falling.

Figure 10:
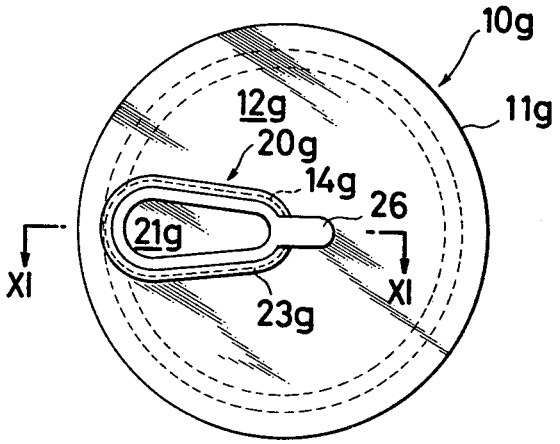
FIGS. 10 and 11 are plan and cross-sectional views, respectively, of another embodiment of the container cover member having an annular resin member interposed between the periphery of the opening in the cover sheet and the closure member of the present invention.
Figure 11:
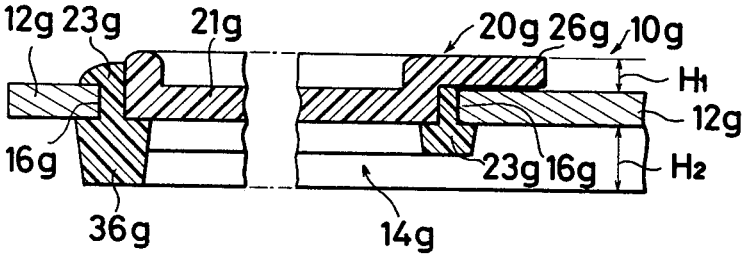

The seventh embodiment of the cover member 10*g* of the present invention which comes under a fourth type is shown in FIGS. 10 and 11. The cover member 10*g* comprises the paper cover sheet 12*g* having the opening 14*g* therein and the thermoplastic synthetic resin closure member 21*g* filled in the opening 14*g* with an annular resin member 23*g* interposed therebetween. In the production of the cover member 10*g*, a suitable paper material is blanked to provide the cover member blank 11*g* and simultaneously form the opening 14*g* in the blank to form the main body 12*g* and synthetic resin is applied to the peripheral edge 16*g* defining the opening 14*g* to form the annular resin member 23*g*. Thereafter, a second synthetic resin which is compatible with the resin of the annular member 23*g* is filled in the opening 14*g* to form the unsealing means 20*g* or the closure member 21*g* to thereby close the opening.

In this embodiment, the resin of the annular member 23*g* is applied to the paper peripheral edge 16*g* of the opening 14*g* in its fused condition so that the annular member firmly adheres to the cover sheet 12*g* and will not inadvertently separate from the cover sheet 12*g*. However, although the second resin of the closure member 21*g* is compatible with the resin of the annular member 23*g* and the annular members 23*g* and closure member 21*g* seem to adhere together firmly, since the annular member 23*g* and closure member 21*g* are formed or molded at different times, when the handle 26*g* is pulled up, the closure member 21*g* easily separates from the annular member 23*g* to thereby easily open the container. Even after the closure member 21*g* has separated from the cover sheet 12*g*, since the peripheral edge 16*g* of the opening 14*g* still remains covered by the annular member 23*g*, the opening 14*g* gives a clean appearance and none of the content of the container will remain on the opening periphery.

Figure 12:
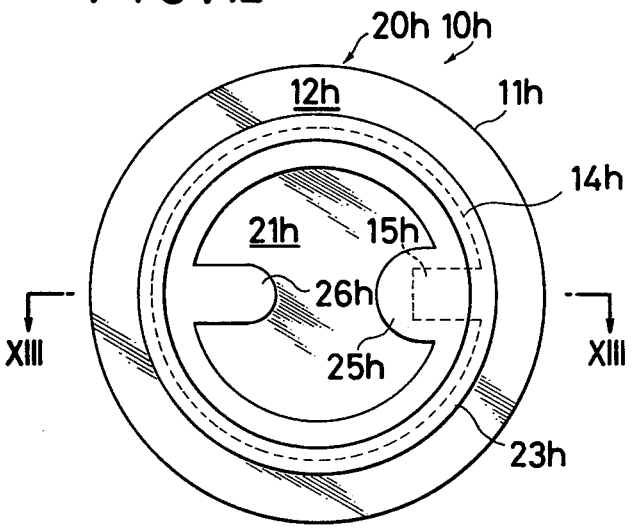
FIGS. 12 and 13 are plan and cross-sectional views, respectively, of another embodiment of the container cover member of the present invention in which an annular resin member positioned in the opening in the cover sheet is provided with a discontinuous portion, a lip is provided in a position of the periphery of the opening extending through the discontinuous portion of the annular resin member into the opening and the closure member is provided with upper and lower flanges sandwiching the lip therebetween.
Figure 13:
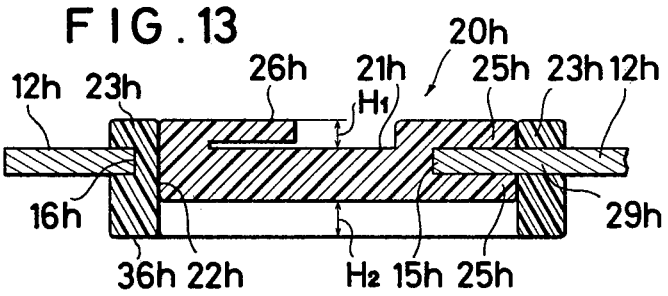

The eighth embodiment of the cover member 10*h* of the present invention which comes under the fourth type is shown in FIGS. 12 and 13. In the production of the container cover member 10*h*, a paper material is blanked or stamped to provide the blank 11*h* having a desired shape to constitute the cover sheet 12*h* having the opening 14*h* therein. In the blanking or stamping, a lip 15*h* is formed in a position in the peripheral edge 16*h* defining the opening 14*h* extending radially and inwardly into the opening 14h for the purpose to be described hereinafter. A first synthetic resin is applied to the peripheral edge 16h of the opening 14h except for the area of the lip 15h to form a substantially annular member 23h having a discontinuous portion 29h as shown in FIG. 13. The substantially annular member 23h is formed to vertically extend upwardly and downwardly of the cover sheet 12h by the distances $H_1$ and $H_2$, respectively. The distance $H_1$ corresponds to the height of the handle 26h above the body of the closure member 21h and the distance $H_2$ is greater than the distance $H_1$. The downward extension of the annular member 23h forms the annular rib 36h below the cover sheet 12h. A second synthetic resin is filled in the opening 14h in the cover sheet 12h to cover the annular member 23h to thereby form the closure member 21h. Thus, the annular resin member 23h and closure member 21h adhere together except for the area of the lip 15h and the lip 15h is sandwiched between the outwardly extending upper and lower flanges 25h, 25h which are formed when the second resin is filled in the opening 14h to form the closure member 21h. The handle 26h is simultaneously formed on the upper surface of the closure member 21h in a position diametrically opposite the projections 25h.

With the above-mentioned construction and arrangement of the components of the cover member 10h, when the handle 26h is pulled up and the edge 22h of the closure member 21h separates from the resin annular member 23h, since the flanges 25h sandwich the lip 15h therebetween, the lip projections 15h serve as the hinge about which the closure member 21h pivots to unseal the container. By the provision of the opening means 20h, the cover members 10h has the advantages that the closure member 21h can be repeatedly closed and opened and that a plurality of the cover member 10h can be easily stacked one upon another.

The foregoing description of the first through eighth embodiments of the invention relates to the cover members in which the cover sheet 11 is blanked or stamped out of a paper or thermoplastic synthetic resin sheet to form the cover member 12 to have a desired size and the cover sheet is further processed. However, in many cases, the cover members of the invention can be rapidly produced on a large scale at low cost as follows.

Figure 14:
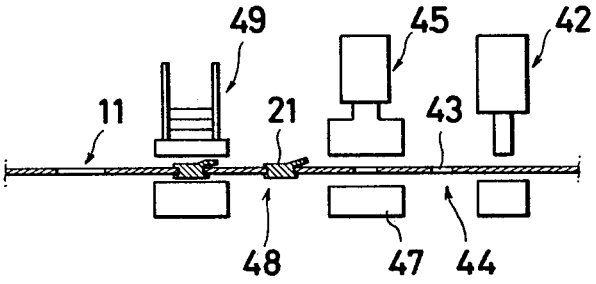
FIG. 14 is a schematic view of a system showing the process for producing a container cover member according to the present invention.

As shown in FIG. 14, a paper sheet stock 41 of relatively rigidity and large size is fed into a first stamping devide 42 where the paper sheet stock 41 is stamped at 43 to provide a second cover member blank having the stamped area 43 which defines the opening 14 in the cover member 10 and the second blank 44 is fed to a synthetic resin molding device 45 to have the unsealing means 20 molded on the blank 44.

The molding device 45 comprises a thermoplastic resin estruder and an injector and the secondary blank 44 having the opening 14 stamped therein is fed to and held between the stationary and movable molds 47. The movable mold 47 is moved toward the stationary mold 47 to injection-mold the closure member 21 having the handle 26 as shown in the embodiments of FIGS. 1 through 8 to provide a third blank 48. The third blank 48 is fed to a second stamping device 49 where the blank 48 is formed into the final or desired cover sheet 12 having the closure member 21 molded thereon.

The process for producing container cover members having unsealing means 20 is not limited to that as described referring to FIG. 14 and instead, in many cases, easily openable container cover members comprising all the resin components are produced by the process described hereinbelow referring to FIG. 15.

Figure 15:
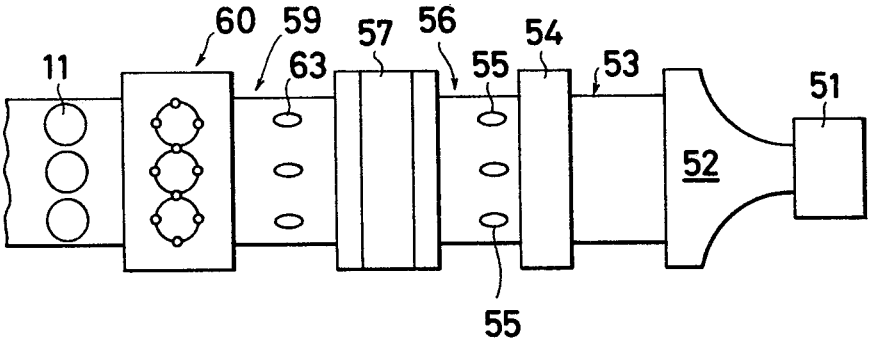
FIG. 15 is a schematic view of a system showing the process for first forming a synthetic resin sheet and then producing a number of container cover members from the resin sheet.

Referring to FIG. 15, thermoplastic synthetic resin (referred to simply as "first resin" hereinafter) is heated in an extruder 51 to a temperature above the melting point thereof and extruded out of the extruder. The extrusion is then fed to a sheeting die 52 where the extrusion is formed into a primary sheet 53 which is then fed to a first stamping device 54 where the sheet 53 is stamped at 55 so as to provide a plurality of through bores which each defines the opening 14 in the cover sheet 12 to become a secondary sheet 56.

Figure 16:
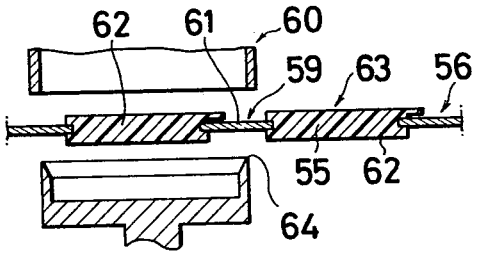
FIG. 16 is a fragmentary cross-sectional view of the stamping means of the second stamping devide as shown in FIG. 15.

The second sheet 56 is then fed to a first synthetic resin molding device 57 which comprises an injection molding means which consists of a stationary mold and a movable mold. In the molding device, the second sheet 56 is formed integrally with a required three-dimentional molded area 63 such as the unsealing handle 26, for example as shown on the right-hand side of FIG. 16.

The thus formed third sheet 59 having the first stamped area 55 filled with the second resin 62 is then fed to a second stamping device 60 where the sheet 59 is stamped to a desired shaped product. In the stamping operation by the second stamping device 60, the blade of the second stamping device shapes the third sheet 59 to a final product with the second resin 62 filled in the opening formed in the first resin area 61 as shown on the left-hand side of FIG. 16 such as the container cover member which comprises both the cover sheet and unsealing means formed of the same of different synthetic resins as in the first through fourth embodiments.

In the production of a product by separately molding thermo-plastic synthetic resins by the employment of the extruder 51 and injector 57, respectively, since the second sheet 56 which has been stamped by the first stamping device 54 is inserted into the caviry in the extruder as mentioned hereinabove, the injection molding can be positively performed on a number of cover member blanks in a predetermined state and a predetermined position. Thus, the present invention has the advantages that the operation efficiency is enhanced and the generation of defective products can be prevented.

Figure 17:
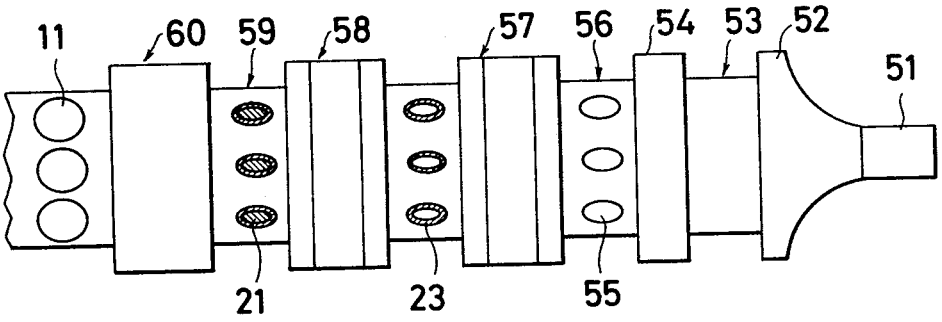
FIG. 17 is a schematic view of another system in which first and second molding devices are employed in carrying out the process of the present invention.

The above-mentioned embodiments of the process of the present invention relates to the process for the production of products comprising two different types of synthetic resins and thus, the process comprises a series of steps of molding a first thermo-plastic resin into the primary sheet 53 by the first molding device or extruder 51, molding the second resin 62 onto the primary sheet by the second molding device or injector 57 and stamping the resulting product to a desired final product. However, the process of the present invention is not limited to such steps. Therefore, in the production of the cover member comprising the cover sheet 12, annular resin member 23 and closure member 21, as shown in FIG. 17, a second molding device 58 is additionally provided between the first molding device 57 and the second stamping device 60 for molding resin into a plurality of stamped areas 55, 55 . . . in the primary sheet 53. In the operation of the system as shown in FIG. 17, the first molding device 57 injection-molds annular resin member 23 into the series of stamped areas 55, 55 . . . in the primary sheet, the second molding device 58 injection-molds closure members 21 into the annular resin members 23 and the second stamping device 60 stamps the resulting sheet into a desired shape to thereby produce the products comprising three different types of synthetic resins as shown in FIGS. 7 and 8 in a continuous manner.

When the sheet 41 or 53 is to be printed, if a stamping device operatively connected to the printer stamps the through holes 55, the first stamping device as shown in FIG. 17 can be, of course, eliminated.

Although the process of the present invention is quite simple as mentioned hereinabove, the increment advancing amount of the sheet 41 or 53 can be controlled so that injection molding is precisely performed in the opening stamped in the sheet and then the processed sheet is stamped to a desired shape to thereby eliminate the possibility of generation of defective products.

While several embodiments of the invention have been shown and described in detail, it will be understood that the same are for illustration purpose only and not to be taken as a definition of the invention, reference being had for this purpose to the appended claims.

What is claimed is:

1. A container cover member comprising a cover sheet for closing on a container open end, said cover sheet having a dispensing opening therethrough, a closure member formed of a synthetic resin closing the dispensing opening, the closure member being generally seated in the dispensing opening and including a handle disposed laterally adjacent the dispensing opening in overlying relation to the cover sheet for displacing the closure member relative to the dispensing opening by an upward force on the handle, and therebeing a synthetic resin rib depending from the underside of the cover sheet, the rib forming means for stacking a plurality of the cover members, and said rib forming means defining a recess for receiving the closure member and handle of an adjacent cover member within said recess when stacked.

2. The container cover member as set forth in claim 1 in which the handle is integrally connected to a movable central part of the closure member which is connected to an outer part of the cover member along a rupturable peripheral weakening line defined by a groove so that when the handle is pulled up it and the central part of the closure member are torn from the remainder of the closure member.

3. The container cover member as set forth in claim 1 in which the synthetic resin closure member has a thinned area remote from the handle, the thinned area forming hinge means for the closure member when the closure member is moved relative to the dispensing opening to an open position.

4. The container cover member as set forth in claim 3 in which the rib is a separate part on the underside of the cover sheet along a peripheral edge of the cover sheet defining the dispensing opening in the cover sheet, the portion of the closure member on the side of the thinned area remote from the handle being fixedly secured to the rib, and a peripheral leg depending from the underside of the hingeable portion of the closure member through the dispensing opening and releasably engaged with the rib to retain the closure member in a dispensing opening sealing portion.

5. The container cover member as set forth in claim 1 in which the rib, the cover sheet and the closure member are all separately formed and connected together by a connecting portion extending through the dispensing opening.

6. The container cover member as set forth in claim 1 in which a portion of the rib is disposed in the dispensing opening between the peripheral edge of the cover sheet defining the dispensing opening and an adjacent portion of the closure member, an outer surface of the rib covering the peripheral edge and an inner surface of the rib joining the closure member, the rib being separate from the closure member.

7. The container cover member as set forth in claim 6 in which the rib has a discontinuous area, and a lip extends from the peripheral edge of the cover sheet defining the dispensing opening into the rib through the discontinuous area and is secured to the cover sheet.

8. The container cover member as set forth in claim 1 wherein the rib is circular in outline.

9. The container cover member as set forth in claim 1 wherein the rib has a height greater than that of the handle.

10. The container cover member as set forth in claim 2 wherein the outer part of the closure member has a depending projection seated in the rib.

11. A container cover member comprising; a cover sheet formed of paper or thermoplastic synthetic resin and having a stamped opening of a suitable size; a synthetic resin closure member in sheet form covering said opening and having an unsealing handle extending therefrom as one body to uncover the opening by pulling up said handle; and a synthetic resin rib extending from the underside of said cover sheet downwardly along the peripheral portion thereof and entirely radially outwardly of said closure member and said handle, the height of said rib being greater than the height of said handle above the upper surface of the closure member, and said rib forming means defining a recess for receiving the closure member and handle of an adjacent cover member within said recess when stacked.

12. The container cover member as set forth in claim 11, in which said closure member and said rib are connected together by means of a connection portion.

13. The container cover member as set forth in claim 11, in which a portion of said rib is interposed between the peripheral edge defining said opening in the cover sheet and said closure member with the outer side of said rib portion covering said periphery defining the opening and the inner side joining said closure member, said rib being formed by a different molding step from the closure member molding.

14. The container cover member as set forth in claim 13, in which said rib is provided with a discontinuous area and a lip extends from the peripheral edge defining said opening in the cover sheet into said rib through said discontinuous area and is secured to said closure member.

* * * * *